US009805629B2

(12) United States Patent
Lee

(10) Patent No.: US 9,805,629 B2
(45) Date of Patent: Oct. 31, 2017

(54) TRANSPARENT ELECTRONIC DISPLAY BOARD CAPABLE OF UNIFORM OPTICAL OUTPUT

(71) Applicant: G-SMATT CO., LTD., Gyeonggi-do (KR)

(72) Inventor: Ho Joon Lee, Seoul (KR)

(73) Assignee: G-SMATT CO., LTD., Gyeonggi-Do (KR)

( * ) Notice: Subject to any disclaimer, the term of this patent is extended or adjusted under 35 U.S.C. 154(b) by 382 days.

(21) Appl. No.: 14/436,889

(22) PCT Filed: Jul. 19, 2013

(86) PCT No.: PCT/KR2013/006477

§ 371 (c)(1),
(2) Date: Apr. 18, 2015

(87) PCT Pub. No.: WO2014/061902

PCT Pub. Date: Apr. 24, 2014

(65) Prior Publication Data

US 2015/0287348 A1 Oct. 8, 2015

(30) Foreign Application Priority Data

Oct. 18, 2012 (KR) ..... 10-2012-0116080

(51) Int. Cl.
*G09F 9/33* (2006.01)
*G09F 13/22* (2006.01)
(Continued)

(52) U.S. Cl.
CPC ..... *G09F 9/33* (2013.01); *F21V 19/0025* (2013.01); *F21V 23/002* (2013.01); *G09F 13/22* (2013.01);
(Continued)

(58) Field of Classification Search
CPC ..... G09F 9/33; G09F 13/22; G09F 2013/222; F21V 23/002; F21V 19/0025;
(Continued)

(56) References Cited

U.S. PATENT DOCUMENTS 6,066,916 A * 5/2000 Osada ..... H05B 33/26 313/504
7,714,500 B2 * 5/2010 Hirakata ..... H01L 25/048 313/504
(Continued)

FOREIGN PATENT DOCUMENTS

JP H06-308321 A 11/1994
JP H08-171096 A 7/1996
(Continued)

OTHER PUBLICATIONS

International Search Report for PCT/KR2013/006477.
Written Opinion for PCT/KR2013/006477.

*Primary Examiner* — Donald Raleigh
(74) *Attorney, Agent, or Firm* — The PL Law Group, PLLC

(57) ABSTRACT

The present invention relates to a transparent electronic display board that is capable of uniform optical output and, more particularly, to a transparent electronic display board that is capable of uniform optical output wherein the pattern width and length are adjusted according to the sheet resistance of a transparent electrode of the transparent electronic display board, wherein a driving voltage applied to a light-emitting device can be uniformly supplied within a constant range, and wherein multiple light sources disposed in the transparent electronic display board can emit light at uniform intensity.

6 Claims, 8 Drawing Sheets

(51) Int. Cl.

| | |
|---|---|
| ***F21V 19/00*** | (2006.01) |
| ***F21V 23/00*** | (2015.01) |
| *F21Y 105/10* | (2016.01) |
| *F21Y 115/10* | (2016.01) |

(52) U.S. Cl.
CPC ..... *F21Y 2105/10* (2016.08); *F21Y 2115/10* (2016.08); *G09F 2013/222* (2013.01)

(58) Field of Classification Search
CPC ..... F21Y 2115/10; F21Y 2105/10; H01L 25/075; H01L 25/0753; H01R 13/66; H01R 13/6641; H01R 13/7175
USPC ..... 313/504
See application file for complete search history.

(56) References Cited

U.S. PATENT DOCUMENTS

| | | | | |
|---|---|---|---|---|
| 8,695,871 | B2 * | 4/2014 | Wakamoto | G06K 7/10346 235/375 |
| 2008/0231165 | A1 * | 9/2008 | Lee | H01J 29/92 313/495 |
| 2009/0021496 | A1 * | 1/2009 | Silzars | G09F 13/22 345/204 |
| 2012/0224244 | A1 * | 9/2012 | Park | G02B 5/23 359/242 |
| 2013/0099666 | A1 * | 4/2013 | Stuffle | G09F 13/22 315/52 |

FOREIGN PATENT DOCUMENTS

| | | | |
|---|---|---|---|
| JP | H11-268331 | A | 10/1999 |
| JP | 2010-134981 | A | 6/2010 |
| JP | 2012-076304 | A | 4/2012 |

* cited by examiner

TRANSPARENT ELECTRONIC DISPLAY BOARD CAPABLE OF UNIFORM OPTICAL OUTPUT

CROSS REFERENCE TO RELATED APPLICATIONS AND CLAIM OF PRIORITY

This patent application claims benefit under 35 U.S.C. 119(e), 120, 121, or 365(c), and is a National Stage entry from International Application No. PCT/KR2013/006477, filed 19 Jul. 2013, which claims priority to Korean Patent Application No. 10-2012-0116080, filed 18 Oct. 2012, entire contents of which are incorporated herein by reference.

BACKGROUND

Field

The present invention generally relates to a transparent electronic display board capable of producing a uniform optical output. More particularly, the present invention relates to a transparent electronic display board capable of producing a uniform optical output, in which a driving voltage applied to a light-emitting element can be uniformly supplied within a constant range by adjusting the width and length of patterns according to the sheet resistance of a transparent electrode, so that multiple light sources installed in the transparent electronic display board can emit light at uniform intensity, thus producing a uniform optical output.

Description of the Related Art

Generally, an electronic display board using neon, a cold cathode lamp (CCL), or a light emitting diode (LED) is widely used as an outdoor light-emitting device. Also, an external electrode fluorescent lamp (EEFL), a cold cathode fluorescent lamp (CCFL), a light-emitting diode electronic display board, or the like is used as an indoor light-emitting device.

In this case, neon or a cold cathode lamp is disadvantageous because it consumes excessive power due to the use of high-voltage power, has the risks of electric shock and fire, and has a short lifespan. Also, an EEEL or a CCFL is disadvantageous because outdoor use is difficult due to the high frequency use, and because it has low illuminance and a short lifespan.

Also, an electronic display board using an LED is characterized in that it emits light only in one direction because the back of the light emitting surface is blocked by a cover plate due to the processing of an electric wire or a black membrane.

On the other hand, contemporary light-emitting devices are being used as advertising boards rather than merely just for lighting, or are widely used for interior decoration design wherein an aesthetic sense is added.

However, the aforementioned light emitting devices have a limitation in assigning an aesthetic sense due to constraints such as the size of the lamp and the size of the stand or the like supporting such a light-emitting device.

Consequently, in the past, to assign the above-described aesthetic sense to a light-emitting device, a transparent electronic display board was released, in which multiple light-emitting elements were attached to a transparent electrode and were configured to emit light using a controller, thus displaying characters or figures on the transparent electrode, and also representing videos. In the transparent electronic display board, multiple light-emitting elements form connectivity patterns on a transparent electrode. Typically, as the light-emitting elements, light-emitting elements having a two-electrode structure, a three-electrode structure, and a four-electrode structure were used. A view of connectivity patterns of a transparent electronic display board to which four-electrode light-emitting elements are applied, among conventional transparent electronic display boards, is illustrated in FIG. 1.

Illustrated in FIG. 1 is an exemplary view of the connectivity patterns for conventional transparent electronic display boards using four-electrode light-emitting elements.

Referring to FIG. 1, the conventional transparent electronic display board includes multiple light-emitting elements 1 fixedly bonded by transparent resin between two transparent electrodes 2 disposed opposite each other; connectivity patterns 2*a* to 2*d* of the transparent electrodes, connected to any one electrode of each light-emitting element 1 via a coating on the transparent electrode 2; and conductive tape 2*a*' to 2*d*' configured to guide power to the connectivity patterns 2*a* to 2*d* of the transparent electrodes.

The multiple light-emitting elements 1 are four-electrode light-emitting elements 1, in which one cathode electrode and three anode electrodes are formed, and the electrodes are respectively connected to connectivity patterns 2*a* to 2*d* extending from different transparent electrode conductive tapes. Here, the multiple light-emitting elements 1 are vertically arranged in a line, and multiple lines in which the light-emitting elements 1 are vertically aligned are formed.

The connectivity patterns 2*a* to 2*d* are extended from the transparent electrode conductive tape, and are respectively connected to the anode electrodes and cathode electrode of the corresponding four-electrode light-emitting element 1. Here, the connectivity patterns 2*a* to 2*d* have separate shapes insulated from each other so that they are not in contact with each other.

Further, the connectivity patterns 2*a* to 2*d* have shapes extending from both ends to the light-emitting elements 1 sequentially aligned in a center portion. That is, to function as a ground terminal, the first connectivity pattern 2*a* connected to the cathode electrode and the second to fourth connectivity patterns 2*b* to 2*d* connected to the anode electrodes are sequentially connected. Behind the fourth connectivity pattern 2*d*, fifth to seventh connectivity patterns 2*e* to 2*g* connected to anode electrodes are extended again. Here, the first connectivity pattern 2*a* connected to the cathode electrode is formed again subsequently to the seventh connectivity pattern 2*g* connected to an anode electrode.

Therefore, the conventional transparent electronic display board is problematic because a connectivity pattern connected to the cathode electrode of the light-emitting element and used as a ground terminal, is set according to the number of light-emitting elements aligned in a vertical or horizontal direction, meaning, man-hours are added in the manufacturing process, thus increasing manufacturing costs and deteriorating productivity.

Further, since the conventional transparent electronic display board has different light-emitting element locations, extended lengths of the connectivity patterns connected to the electrodes of the respective light-emitting elements are different from each other, but the widths thereof are identical to each other.

Since the conventional transparent electronic display board has the sheet resistance of the transparent electrode itself and resistance per unit area of each connectivity pattern, the range of voltage loss differs depending on the widths and lengths of the connectivity patterns, so that a drive voltage applied to a light-emitting element connected at the location where the length of a connectivity pattern is extended as the longest length is different from a drive voltage applied to a light-emitting element connected at the location where the length of the connectivity pattern is the shortest.

Accordingly, the conventional transparent electronic display board is problematic in that, as drive voltages falling within different ranges are applied to respective light-emitting elements fixed at different locations, and are used to drive the light-emitting elements, non-uniform light is output at different intensities, thus making it difficult to implement clear image quality upon displaying images or videos.

The present invention has been made keeping in mind the above problems, and one aspect of the present invention is to provide a transparent electronic display board, in which the widths of connectivity patterns required to supply power to light-emitting elements in the transparent electronic display board are selectively formed in consideration of the sheet resistance and length of each transparent electrode, thus enabling all light-emitting elements to exhibit a uniform optical output.

SUMMARY

In one embodiment, the present invention provides a transparent electronic display board capable of producing a uniform optical output, which compensates for the loss of voltages depending on resistances by increasing the widths of connectivity patterns as the lengths thereof become larger, wherein the connectivity patterns are connected to transparent electrodes for applying power of one or more light-emitting elements, which are fixed on at least one surface of a pair of transparent plates spaced apart from each other and bonded by transparent resin loaded therebetween, and which emit light using applied power.

The present invention is advantageous because the widths of connectivity patterns connected to light-emitting elements are selectively formed so that the loss of power caused by the sheet resistance and length of transparent electrodes can be compensated for, so that all light-emitting elements installed in a transparent electronic display board have a uniform optical output, thus realizing precise images and videos, and providing a screen having a clear image quality.

DETAILED DESCRIPTION

Figure 1:
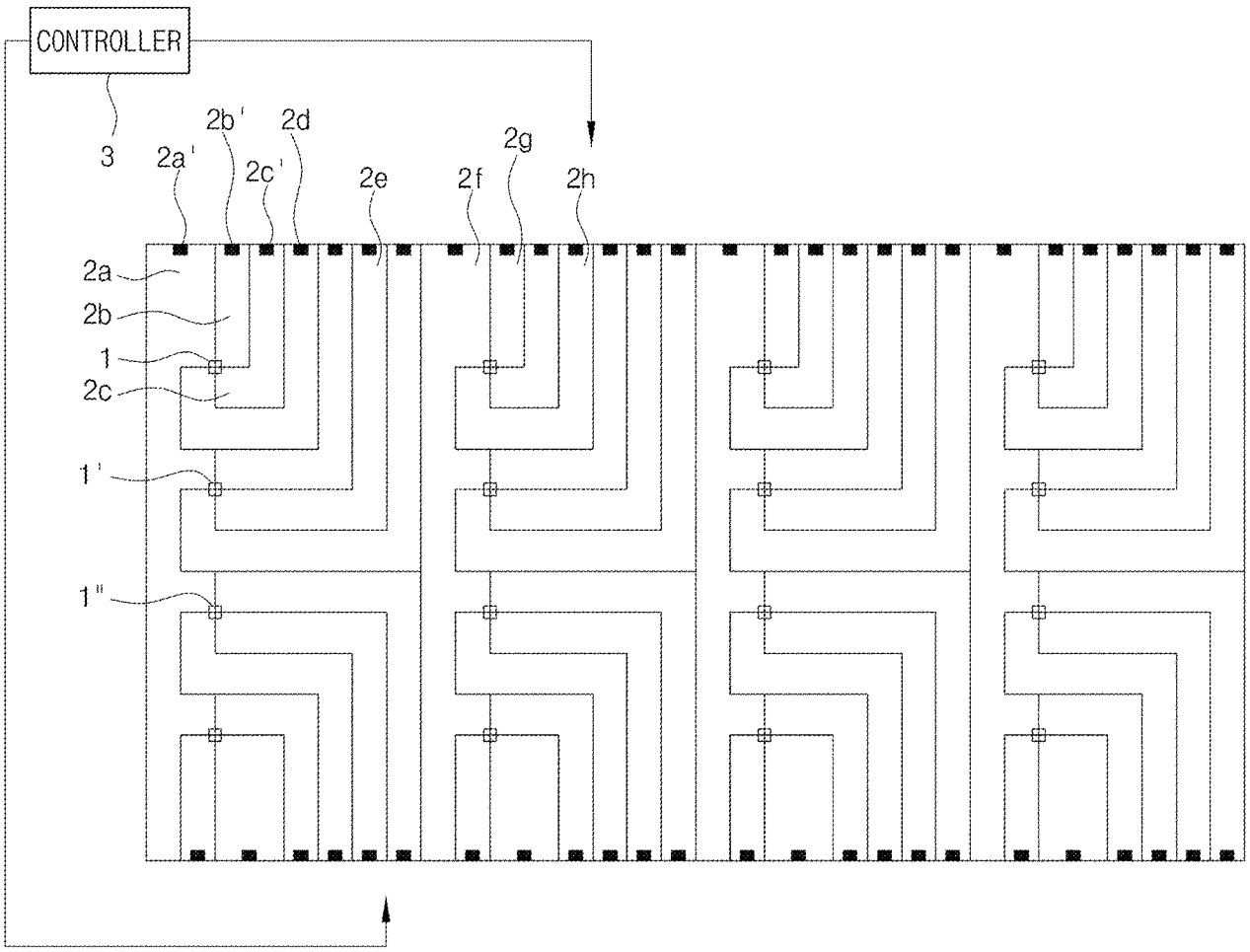
FIG. 1 is a plan view showing a conventional transparent electronic display board.

The present invention includes the following embodiments.

In one embodiment, a transparent electronic display board capable of producing a uniform optical output according to the present invention includes one or more light-emitting elements fixed on at least one surface of a pair of transparent plates bonded to each other so that the transparent plates are spaced apart from each other by transparent resin; transparent electrodes formed by applying a conductive material to a corresponding transparent plate and configured to apply power of the one or more light-emitting elements; and connectivity patterns etched from each transparent electrode and connected to respective electrodes of the light-emitting elements at different lengths so that electrical signals are transferred to the light-emitting elements, wherein widths of the connectivity patterns are increased as the lengths of the connectivity patterns connected to the light-emitting elements are increased.

In another embodiment of the present invention, the widths of the connectivity patterns may be calculated using the following Equations 1 and 2:

$$L\ (\text{mm})/W\ (\text{mm}) \times \text{sheet resistance of transparent electrode } (\Omega) = \text{resistance of etched area } (\Omega) \qquad \text{Equation 1}$$

$$\text{rated voltage } (V)/\text{resistance of etched area } (\text{k}\Omega) = I\ (\text{mA}) \qquad \text{Equation 2}$$

where L denotes a length of a connectivity pattern; W denotes a width of the connectivity pattern; 'sheet resistance of transparent electrode' denotes self-sheet resistance of the transparent electrode; 'rated voltage' denotes a voltage applied to the transparent electronic display board; I denotes a current value applied from the connectivity pattern to the corresponding light-emitting element (hereinafter referred to as a 'drive current for the light-emitting element'); and 'resistance of etched area' denotes a resistance value per unit area of the connectivity pattern formed by etching the transparent electrode.

In a further embodiment of the present invention, each light-emitting element may include one or more anode electrodes to which the connectivity patterns are connected, and one cathode electrode, and the connectivity patterns may include one or more anode connectivity patterns etched from the transparent electrode and connected to the anode electrodes; and a single cathode connectivity pattern connected in common to cathode electrodes respectively formed in the multiple light-emitting elements.

In yet another embodiment of the present invention, connection terminals at which the cathode connectivity pattern and the anode connectivity patterns are sequentially extended from at least one of upper/lower and left/right ends of the transparent plate and are connected to transparent conductive tape may be aligned, a connection terminal of the cathode connectivity pattern may be formed in an uppermost portion of the connection terminals, and connection terminals of the one or more anode connectivity patterns may be sequentially extended below the connection terminal of the cathode connectivity pattern.

In still another embodiment of the present invention, the anode connectivity patterns may be respectively connected to the one or more anode electrodes of the light-emitting element, and one or more of the anode connectivity patterns may be spaced apart from each other with the cathode connectivity pattern interposed therebetween and are connected to the anode electrodes.

In still another embodiment of the present invention, one or more light-emitting elements may be aligned in a horizontal or vertical direction, and a number of anode connectivity patterns identical to a number of anode electrodes of each light-emitting element may be extended for each light-emitting element.

Hereinafter, other embodiments of the present invention will be described in detail with the attached drawings.

Figure 2:
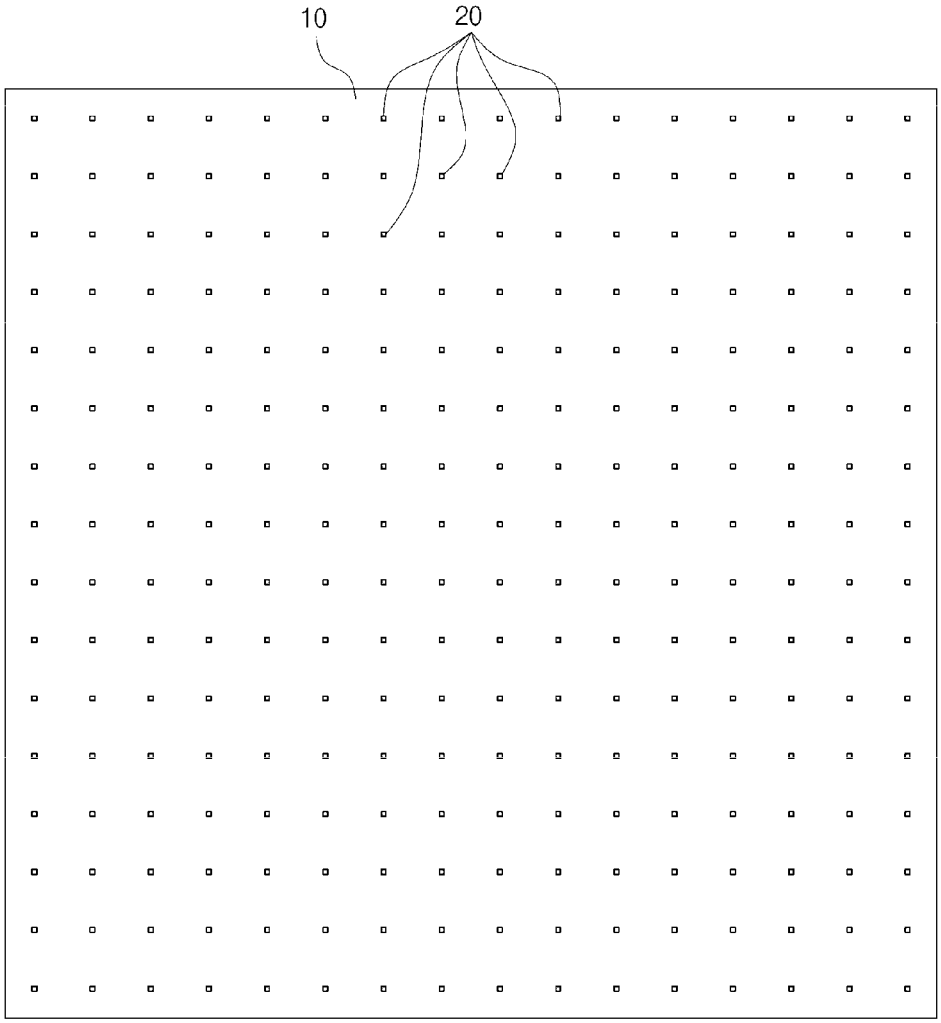
FIGS. 2 and 3 are diagrams showing a transparent electronic display board capable of producing a uniform optical output according to one embodiment of the present invention.
Figure 3:
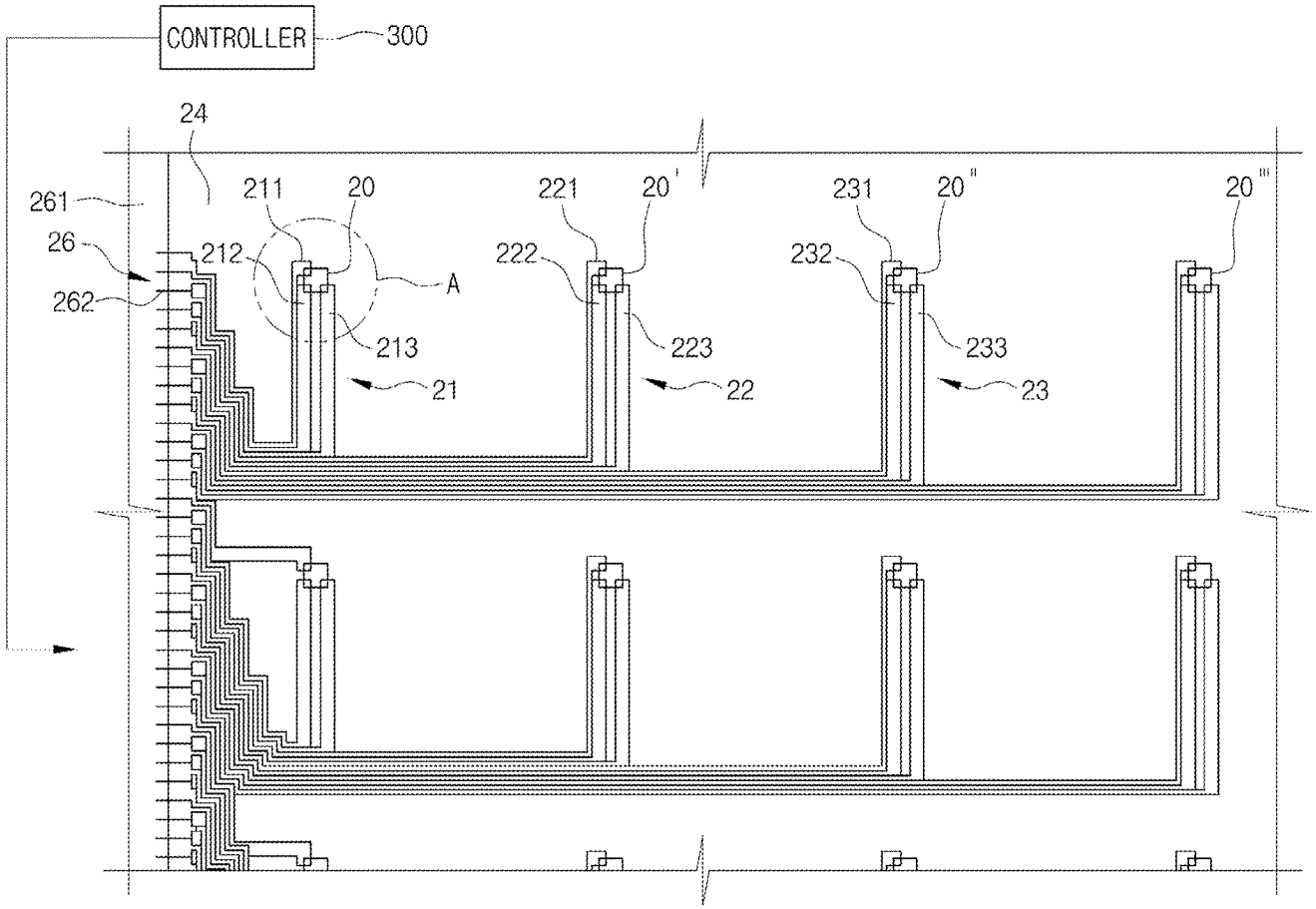
Figure 4:
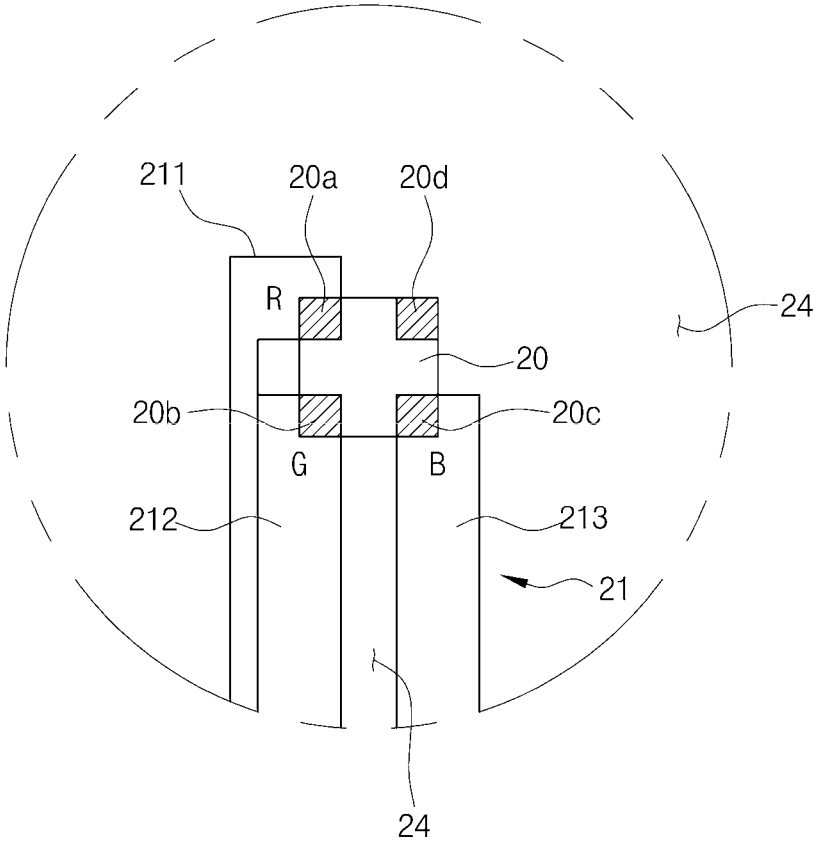
FIG. 4 is an enlarged view showing a light-emitting element in the transparent electronic display board capable of producing a uniform optical output according to one embodiment of the present invention.

FIGS. 2 and 3 are diagrams showing a transparent electronic display board capable of producing a uniform optical output according to one embodiment of the present invention, and FIG. 4 is an enlarged view showing a light-emitting element in the transparent electronic display board capable of producing a uniform optical output according to one embodiment of the present invention.

Referring to FIGS. 2 to 4, the transparent electronic display board according to one embodiment of the present invention includes a pair of transparent plates 10 that are spaced apart from each other and are bonded to each other by transparent resin; transparent electrodes 21 to 24 formed on one surface of any one of the paired transparent plates 10 and are made of a conductive material to guide power; multiple light-emitting elements 20, 20', 20", and 20''' fixed on any one of the paired transparent plates 10 and configured to emit light using power applied through the transparent electrodes 21 to 24; a controller 30 configured to control ON/OFF operations of the light-emitting elements 20, 20', 20", and 20'''; and transparent electrode conductive tape 25 configured to supply power to the transparent electrodes 21 to 24.

The transparent plates 10 are configured such that two transparent plates 10 are mutually opposite each other and are bonded to each other with transparent resin loaded between the plates. The transparent plates 10 may be manufactured using any one of a glass plate, an acrylic plate, and a polycarbonate plate, all of which are made of a transparent material. Since the coupling between the transparent plates 10 and the light-emitting elements 20 is a well-known technology, a separate illustration and a detailed description thereof will be omitted.

The light-emitting elements 20 are luminous bodies turned on or off depending on the supply of power, and are configured such that multiple light-emitting elements are fixed by conductive resin (not shown) in the transparent electrodes 21, 22, and 23 formed on one surface of any one of the paired transparent plates 10. Here, the lower portions of the light-emitting elements 20 are fixed at the transparent electrodes 21, 22, and 23, and the upper portions of the light-emitting elements are protected by transparent resin and are bonded to other transparent electrodes. Here, in each light-emitting element 20, anodes 20*a* to 20*c* and a cathode electrode 20*d* are formed, and the anode electrodes 20*a*, 20*b*, and 20*c* cause positive power to be input or output, and the cathode electrode 20*d* causes negative power to be input or output.

Further, the light-emitting element 20 may be implemented using any one of a two-electrode light-emitting element in which one anode electrode 20*a* to 20*c* and one cathode electrode 20*d* are formed, a three-electrode light-emitting element in which two anode electrodes and one cathode electrode are formed, and a fourth-electrode light-emitting element 20 in which three anode electrodes and one cathode electrode are formed. As an example of the present invention, a description will be made using the four-electrode light-emitting element.

Each of the transparent electrodes 21 to 24 is formed such that any one of an indium tim oxide (ITO), an indium zinc oxide (IZO), and liquid polymer, which are conductive materials, is applied to one surface opposite the other of the paired transparent plates. Each of the transparent electrodes 21 to 24 is partitioned and divided into multiple sections to be insulated from each other so that the multiple sections are respectively connected to the anode electrodes 20*a*, 20*b*, and 20*c* and the cathode electrode 20*d* of the light-emitting element 20, and then one or more connectivity patterns 21 to 24 are formed to be extended to electrically communicate signals to the light-emitting element.

Here, each of the transparent electrodes 21 to 24 is partitioned into sections such that the sections are respectively connected to the anode electrodes 20*a*, 20*b*, and 20*c* and the cathode electrode 20*d* of the light-emitting element 20, and are configured to transfer a control signal applied from the controller 30 to the light-emitting element 20. A description will be made on the assumption that areas which are partitioned from each transparent electrode 21 to 24 to be connected to the anode electrodes 20*a*, 20*b*, and 20*c* and the cathode electrode 20*d* of the light-emitting element are designated as anode connectivity patterns 21 to 23 and the cathode connectivity pattern 24, respectively.

More specifically, the connectivity patterns of the transparent electrodes 21, 22, 23, and 24 include multiple groups, each including one or more anode connectivity patterns 21 to 23 respectively connected to the anode electrodes 20*a*, 20*b*, and 20*c* formed in a single light-emitting element 20 and one cathode connectivity pattern 24 connected to the cathode electrode 20*d*.

The number of anode connectivity patterns 21 to 23 that are formed is identical to the number of anode electrodes 20*a*, 20*b*, and 20*c* of each light-emitting element 20, but there is a single cathode connectivity pattern 24 that is connected in common to the cathode electrodes 20*d* of the multiple light-emitting elements 20.

In the transparent electrodes 21 to 24, multiple groups 21 to 23, each having first to third anode connectivity patterns 211 to 213 respectively connected to the first to third anode electrodes 20*a*, 20*b*, and 20*c* in, for example, the four-electrode light-emitting element 20, are formed.

For example, the first group 21 of the anode connectivity patterns includes a first anode connectivity pattern 211 connected to the first anode electrode 20*a* of the first light-emitting element 20, a second anode connectivity pattern 212 connected to the second anode electrode 20*b*, and a third anode connectivity pattern 213 connected to the third anode electrode 20*c*.

Similarly, the second group 22 and the third group 23 of anode connectivity patterns include first to third anode connectivity patterns 221, 222, and 223 and first to third anode connectivity patterns 231, 232, and 233 connected to the anodes of the second light-emitting element 20' and the third light-emitting element 20", respectively.

However, the cathode connectivity pattern 24 is a common pattern, which is connected in common to the cathode electrodes 20*d* respectively formed on the multiple light-emitting elements 20.

That is, one embodiment of the present invention is configured such that one cathode connectivity pattern 24 is connected in common to the cathode electrodes 20*d* of the multiple light-emitting elements 20 installed on the transparent electronic display board, and such that the anode connectivity patterns 21 to 23 are respectively formed on the anode electrodes 20*a*, 20*b*, and 20*c* of the multiple light-emitting elements 20.

In this regard, the groups 21 to 23 of the anode connectivity patterns are connected to respective light-emitting elements that extend from the end of one side of the transparent plate 10 to the other side thereof and that are aligned in a transverse direction. In this case, the individual groups 21 to 23 of anode connectivity patterns are extended at different lengths depending on the locations of the respective light-emitting elements 20, 20', and 20", and the widths of the anode connectivity patterns 21 to 23 are differently set in consideration of the lengths of anode connectivity patterns and the resistances per unit area of the anode connectivity patterns.

One reason for this is to maintain uniform intensities of light emitted from all light-emitting elements, installed on the entire transparent electronic display board. A detailed description thereof will be made later.

Further, the transparent electrode conductive tape 25 are respectively attached to the connection terminals of the anode connectivity patterns 21 to 23. Yet further, the transparent electrode conductive tape 25 are bonded to the start points of the anode connectivity patterns 21 to 23.

That is, in the transparent electronic display board, connection terminals 26 are aligned wherein the cathode connectivity pattern 24 and the individual groups 21 to 23 of the anode connectivity patterns are sequentially extended from at least one of upper/lower and left/right ends of the transparent plate 10 and are connected to the transparent conductive tape 25.

The connection terminals 26 are configured such that a connection terminal to be connected to the cathode connectivity pattern 24 is formed in an uppermost portion, and connection terminals 26 of the anode connectivity patterns 211 to 233, corresponding to the groups 21 to 23 respectively connected to the one or more anodes, are sequentially extended and formed below the connection terminal of the cathode connection pattern 24.

In addition, respective anode connectivity patterns 211 to 233 included in the groups 21 to 23 are connected to one or more anode electrodes in the light-emitting elements 20, 20', and 20", and one or more of the anode connectivity patterns are spaced apart from each other with the cathode connectivity pattern 24 interposed therebetween, and are connected to the anode electrodes 20*a* to 20*c* (e.g., see the second anode connectivity pattern 212 and the third anode connectivity pattern 213 of FIG. 4).

Further, the respective anode connectivity patterns 211 to 233 of the groups 21 to 23 are extended from the transparent electrode conductive tapes 25 and are connected to the anode electrodes 20*a*, 20*b*, and 20*c* of different light-emitting elements 20. Here, the cathode connectivity pattern 24 corresponds to the remaining area other than an area in which the anode connectivity patterns 211 to 233 are formed.

Furthermore, in order to solve conventional problems (supra) wherein the intensities of optical outputs of the respective light-emitting element 20, 20', and 20" are not uniform due to the differences in the lengths of the anode connectivity patterns 211 to 233 and in the self-resistances thereof per unit area, the present invention sequentially increases the widths of the anode connectivity patterns 211 to 233 connected to the anode electrodes of the light-emitting elements 20, 20', and 20" depending on the sheet resistances and lengths of the connectivity patterns. This will be described in detail later.

Figure 5:
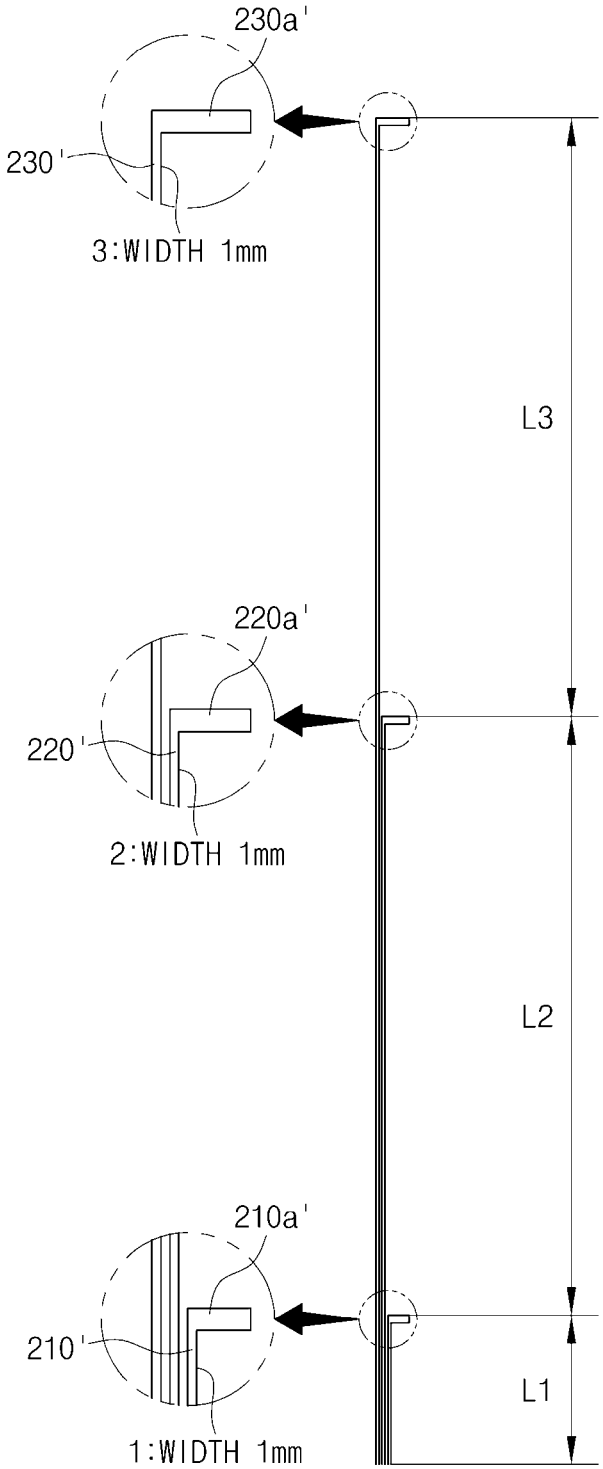
FIG. 5 is a diagram showing a first comparative example of the transparent electronic display board capable of producing a uniform optical output according to one embodiment of the present invention.
Figure 6:
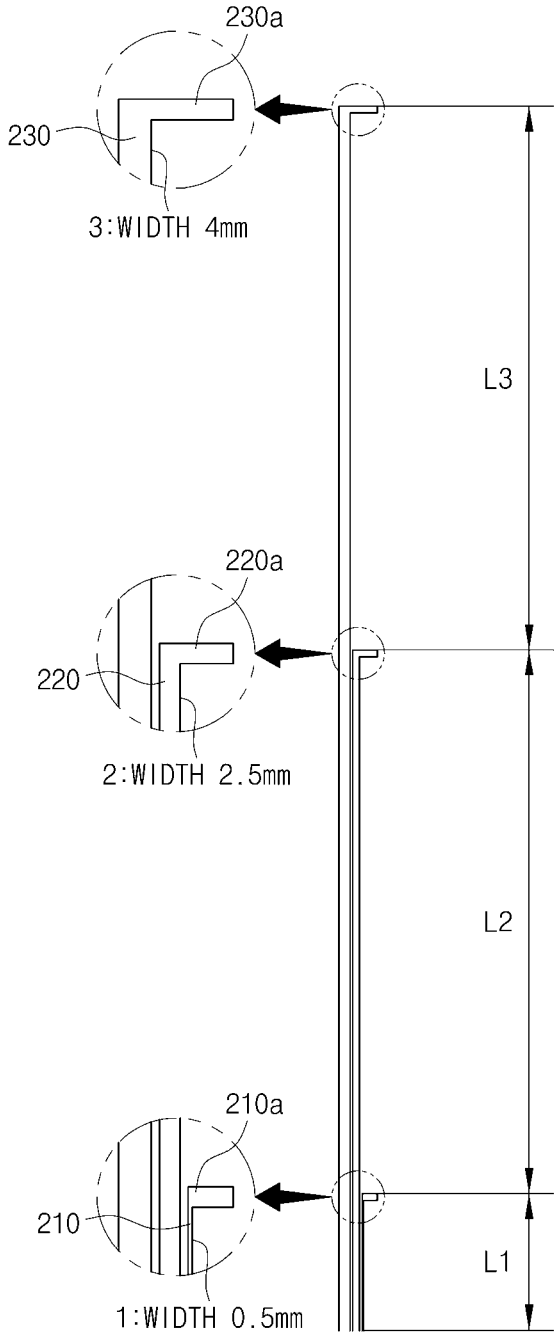
FIG. 6 is a diagram showing a first experimental example of the transparent electronic display board capable of producing a uniform optical output according to one embodiment of the present invention.

FIG. 5 is a diagram showing a first comparative example of the transparent electronic display board capable of producing a uniform optical output according to one embodiment of the present invention, and FIG. 6 is a diagram showing a first experimental example of the transparent electronic display board capable of producing a uniform optical output according to one embodiment of the present invention.

The first comparative example and the first experimental example include anode connectivity patterns 211 to 233 and 211' to 233' of the first to third groups 210 to 230 and 210' to 230' so that the connectivity patterns are connected to the first to third light-emitting elements 20, 20', and 20", respectively. The first to third groups 210 to 230 denote the groups 21 to 23 of anode connectivity patterns connected to the above-described light-emitting elements, and are each shown as being formed as, for example, a single pattern, in FIGS. 5 and 6.

Also, in the attached FIGS. 5 and 6, first to third light-emitting elements connected to the ends of the first to third anode connectivity patterns are not illustrated.

Each of the first experimental example and the first comparative example includes a first group 210' or 210 connected to the first light-emitting element 20, a second group 220' or 220 connected to the second light-emitting element 20', and a third group 230 or 230' connected to the third light-emitting element 20", and extended lengths L1, L2, and L3 for respective groups are different from each other.

Further, the first experimental example was set such that the widths of the anode connectivity patterns 211 to 233 of the respective groups 210 to 230 were sequentially increased depending on the extended lengths, and the first comparative example was set such that the widths of the anode connectivity patterns 211' to 233' were identical to each other regardless of the extended lengths.

Here, the light-emitting element 20 is configured such that coupling terminals 210*a*, 210*a'*, 210*b*, 210*b'*, 210*c*, and 210*c'*, which are formed to be horizontally bent at the ends of the respective anode connectivity patterns 211 to 233 and 211' to 233' corresponding to the first to third groups 210, 210' 220, 220', 230, and 230', are bonded to the one or more electrodes 20*a* to 20*c* respectively formed in the light-emitting elements 20, 20', and 20".

From the first experimental example and the first comparative example, current values applied to the light-emitting elements 20, 20', and 20" were measured at the coupling terminals 210*a*, 210*a'*, 210*b*, 210*b'*, 210*c*, and 210*c'*, and variations in the current values with an increase in the widths of the patterns along the lengths of the patterns were measured and compared. The current values are calculated using the following Equations 1 and 2:

$$L\ (\text{mm})/W\ (\text{mm}) \times \text{sheet resistance of transparent electrode}\ (\Omega) = \text{resistance of etched area}\ (\Omega) \quad \text{Equation 1}$$

$$V/\text{resistance of etched area}\ (\text{k}\Omega) = I\ (\text{mA}) \quad \text{Equation 2}$$

where L denotes the length of each anode connectivity pattern; W denotes the width of the anode connectivity pattern; 'sheet resistance of transparent electrode' denotes self-sheet resistance of the transparent electrode; V denotes a rated voltage; I denotes a current value applied from the anode connectivity pattern to the corresponding light-emitting element (hereinafter referred to as a 'drive current for the light-emitting element'); and 'resistance of etched area' denotes a resistance value per unit area of the anode connectivity pattern formed by etching the transparent electrode.

The sheet resistance value of the transparent electrode may have deviations depending on, for example, different manufacturing companies and product specifications, and products most widely used typically use a resistance of 14Ω.

Therefore, the present invention may maintain drive currents applied to the first to third light-emitting elements 20, 20' and 20" by adjusting the widths or lengths of the anode connectivity patterns at uniform levels falling within a predetermined range, thus enabling the first to third light-emitting elements 20, 20', and 20" to output a uniform quantity of light.

As described above, the present invention may adjust drive current values applied to the light-emitting elements 20, 20', and 20" by adjusting the widths of the anode connectivity patterns 211 to 233, or may also adjust the drive currents of the light-emitting elements by adjusting the lengths of the anode connectivity patterns other than the widths thereof, depending on the application/needs of a designer or a user. The setting of uniform drive current values by adjusting the widths or lengths of the anode connectivity patterns corresponds to any one of various modifications falling within the scope of the technical spirit of the present invention.

Below, the operations and effects implemented by the technical spirit of the above-described present invention will be described by comparing experimental data required to prove uniform output of drive current values depending on the widths of the anode connectivity patterns with conventional drive current values.

Table 1 shows data obtained by measuring drive currents in the first comparative example. Here, a rated voltage was 12 V, and products of the same specification having a reference current of 5 mA were used as the first to third light-emitting elements 20, 20', and 20".

As the drive currents, applied currents were measured at coupling terminals connected to the electrodes of the light-emitting elements 20, 20', and 20", a sheet resistance of the transparent electrode was set to 14Ω, the rated voltage was set to 12 V, and then the same voltage was applied to all of the anode connectivity patterns.

TABLE 1

| Connectivity pattern No. | First etched area resistance (theoretical value, kΩ) | First drive current (mA) | Second etched area resistance (measured value, kΩ) | Second drive current (mA) |
|---|---|---|---|---|
| 1 | 0.76 | 15.79 | 0.71 | 13.31 |
| 2 | 3.57 | 3.36 | 3.77 | 2.77 |
| 3 | 6.39 | 1.88 | 6.85 | 1.56 |

The first drive currents denote current values that are calculated using the resistances of a first etched area checked via the specifications of products and that are measured at the coupling terminals 210*a*' to 230*a*' of respective anode connectivity patterns of first to third groups 210' to 230', and the second drive currents denote values that are actually measured at the coupling terminals 210*a*' to 230*a*' of the connectivity patterns of the first to third groups 210' to 230'.

In this case, for the anode connectivity patterns 211' to 233' of the first to third groups 210' to 230', the lengths of the anode connectivity patterns 211' to 213' of the first group 210' are extended to the shortest length, and the anode connectivity patterns 231' to 233' of the third group 230' are extended to the longest length, but the widths of the patterns are equal to each other.

Under such a condition, it can be seen that a variation of a maximum of 12 mA occurs in currents measured at the coupling terminals 210*a*' to 230*a*' depending on the lengths of the anode connectivity patterns.

Table 2 shows data obtained by respectively measuring drive currents in the first experimental example. Here, the lengths L1, L2, and L3 of the anode connectivity patterns in the first experimental example are identical to the lengths L1, L2, and L3 in the first comparative example, but the widths of the patterns are widened as the lengths are increased. The experimental condition was set such that a rated voltage was 12 V, and the reference current value of each light-emitting element was 5 mA, and thus a product having the same specification as that of the first comparative example was used.

Further, the width of each anode connectivity pattern 211 to 213 of the first group 210 was 0.5 mm, the width of each anode connectivity pattern 221 to 223 of the second group 220 was 2.5 mm, and the width of each anode connectivity pattern 231 to 233 of the third group 230 was 4 mm. The widths of the anode connectivity patterns were increased as the lengths L1, L2, and L3 of the anode connectivity patterns were extended.

TABLE 2

| Connectivity pattern No. | First etched area resistance (theoretical value, kΩ) | First drive current (mA) | Second etched area resistance (measured value, kΩ) | Second drive current (mA) |
|---|---|---|---|---|
| 1 | 1.42 | 8.45 | 1.28 | 6.80 |
| 2 | 1.44 | 8.33 | 1.28 | 6.83 |
| 3 | 1.64 | 7.32 | 1.46 | 6.00 |

When the drive current values shown in Table 2 were checked, deviations between values of a first drive current and a second drive current measured at the coupling terminal 210*a* of the anode connectivity patterns 211 to 213 of the first group 210 and at the coupling terminal 230*a* of the anode connectivity patterns 231 to 233 of the third group 230 did not exceed a maximum of 1.2 mA.

That is, drive currents, which are measured at the coupling terminals 210*a* to 230*a* of the anode connectivity patterns for respective groups 210 to 230 and are applied to the light-emitting elements 20, 20', and 20", are increased as the widths of the anode connectivity patterns are increased, so that it can be seen that, unlike the data of Table 1, the loss of current depending on the lengths of the anode connectivity patterns 211 to 233 is compensated for.

Further, the present applicant compared a second comparative example in which the widths of anode connectivity patterns are uniform with a second experimental example in which the widths of anode connectivity patterns are sequentially increased, via a transparent electronic display board to which four-electrode light-emitting elements designed to configure a total of four anode connectivity patterns in each group are applied.

Figure 7:
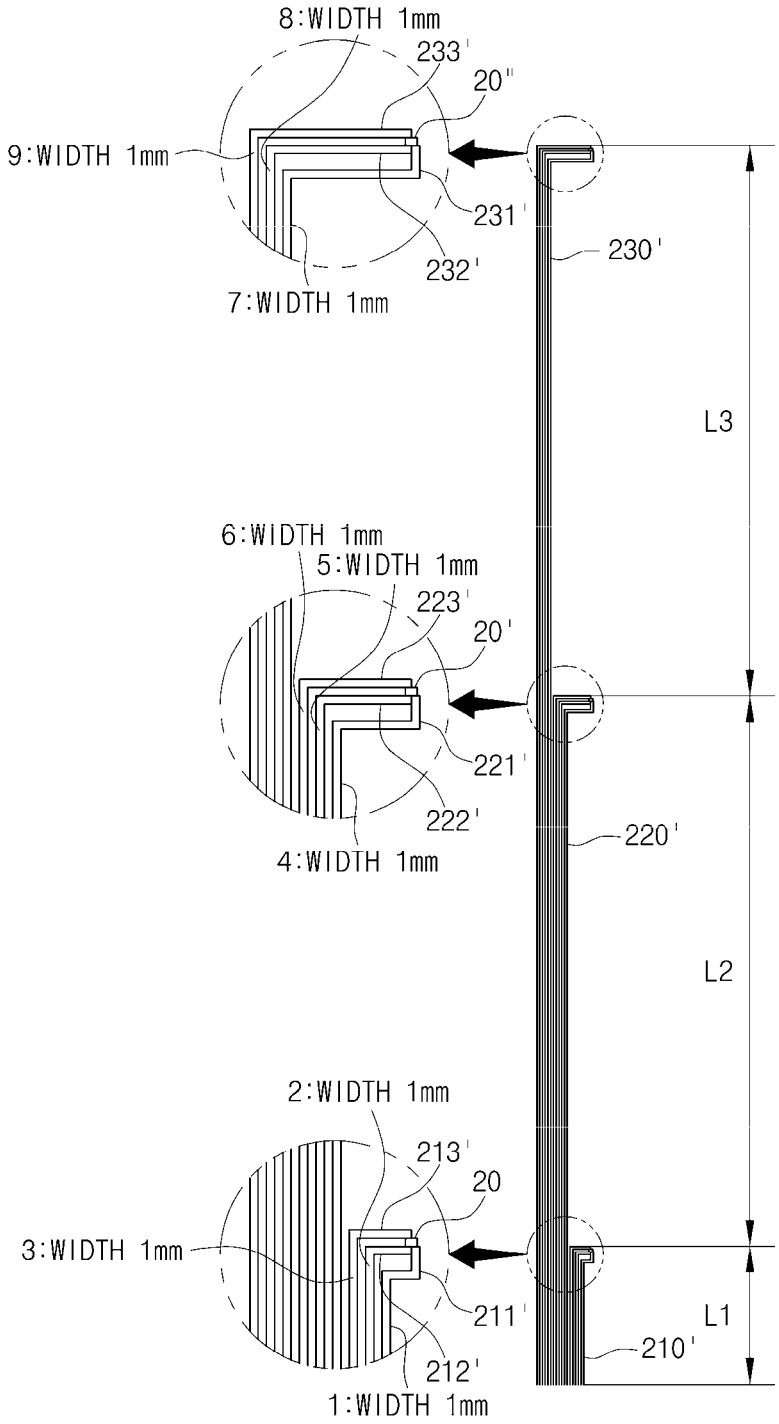
FIG. 7 is a diagram showing a second comparative example of the transparent electronic display board capable of producing a uniform optical output according to one embodiment of the present invention.
Figure 8:
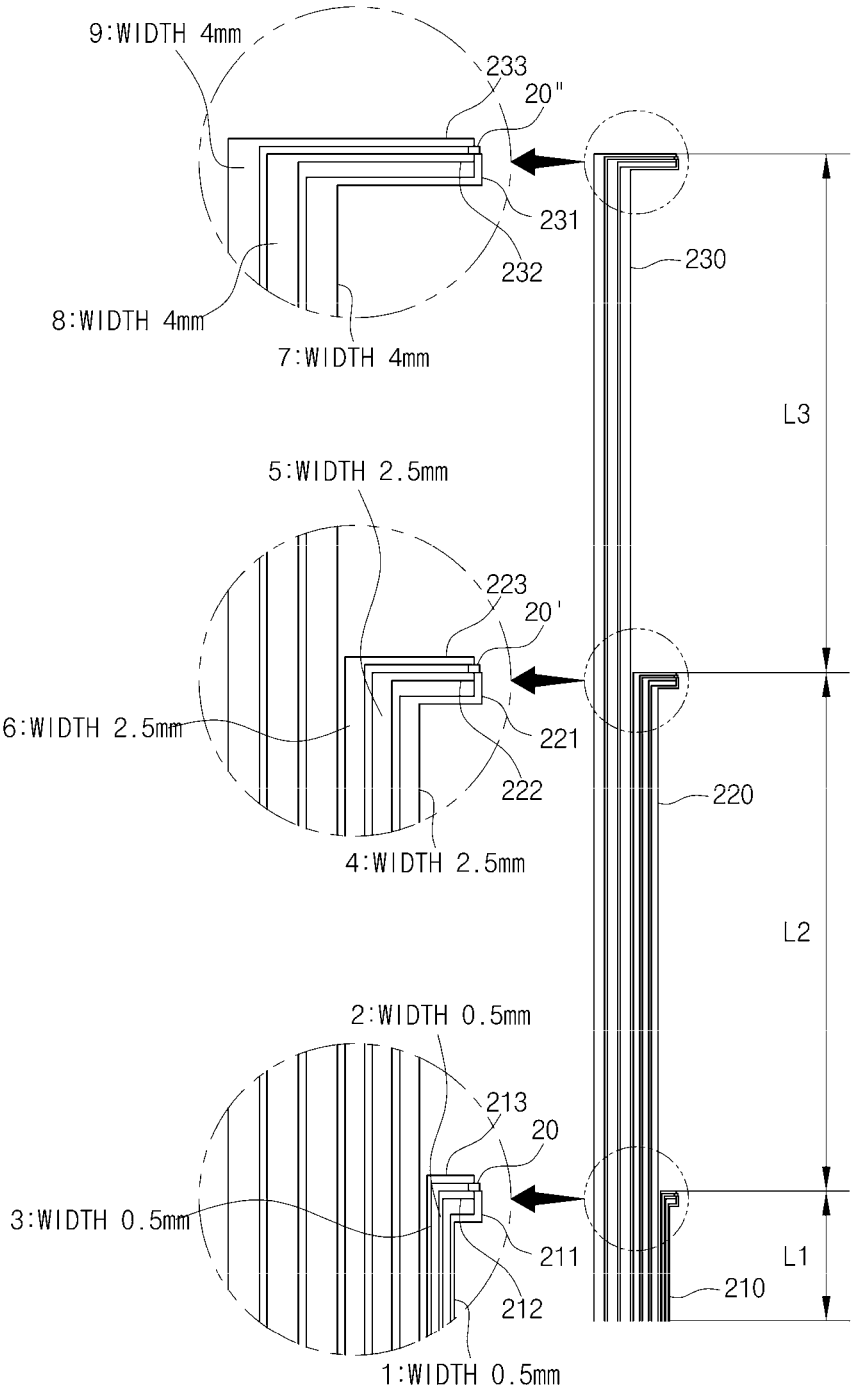
FIG. 8 is diagram showing a second experimental example of the transparent electronic display board capable of producing a uniform optical output according to one embodiment of the present invention.

FIG. 7 is a diagram showing a second comparative example of the transparent electronic display board capable of producing a uniform optical output according to one embodiment of the present invention, and FIG. 8 is a second experimental example of the transparent electronic display board capable of producing a uniform optical output according to one embodiment of the present invention.

Referring to FIG. 7, the second comparative example includes one or more groups 21 to 23 having one or more anode connectivity patterns 211 to 233 that are formed as patterns by etching transparent electrodes 21 to 24, which are formed by applying a conductive material to one surface of the transparent plate 10; and one or more light-emitting elements 20, 20', and 20" for emitting light using power applied from the anode connectivity patterns 211 to 233.

Here, the light-emitting elements 20, 20', and 20" are described using four-electrode light-emitting elements by way of example, and as described above, the cathode electrodes of the respective light-emitting elements are connected to each other via a cathode connectivity pattern 24.

The respective groups 210' to 230', in which one or more anode connectivity patterns 211' to 233' are included, have lengths that are sequentially increased for the respective groups, and the first to third anode connectivity patterns 211' to 233' of the respective groups 210' to 230' are connected to the anode electrodes of the light-emitting elements 20, 20', and 20".

The respective anode connectivity patterns 211' to 233' of the first to third groups 210' to 230' have the same width of 1 mm, and the lengths thereof are gradually increased in the sequence of the first to third groups 210' to 230'. In the first group 210', first to third anode connectivity patterns 211' to 213' connected to the respective electrodes of the first light-emitting element 20 are formed. In the second group 220', forth to sixth anode connectivity patterns 221' to 223' connected to the respective electrodes of the second light-emitting element 20' are formed. In the third group 230', seventh to ninth anode connectivity patterns 231' to 233' connected to the respective electrodes of the third light-emitting element 20" are formed. Here, the widths of the first to ninth anode connectivity patterns 211' to 233' are identical, and the lengths thereof differ for the respective groups. Measured data for the second comparative example is given in Table 3.

TABLE 3

| Connectivity pattern No. | First etched area resistance (theoretical value, kΩ) | First drive current (mA) | Second etched area resistance (measured value, kΩ) | Second drive current (mA) |
|---|---|---|---|---|
| 1 | 0.77 | 15.58 | 0.72 | 13.43 |
| 2 | 0.78 | 15.38 | 0.74 | 12.03 |
| 3 | 0.83 | 14.36 | 0.80 | 11.46 |
| 4 | 3.66 | 3.28 | 3.83 | 2.73 |
| 5 | 3.66 | 3.28 | 3.86 | 2.51 |
| 6 | 3.71 | 3.23 | 3.92 | 2.43 |
| 7 | 6.54 | 1.83 | 7.02 | 1.48 |
| 8 | 6.55 | 1.83 | 7.01 | 1.36 |
| 9 | 6.60 | 1.82 | 7.06 | 1.37 |

A rated voltage was 12 V, a reference current was 5 mA, and the sheet resistance of each transparent electrode was 14Ω. The drive currents were measured for respective anode connectivity patterns.

Referring to Table 3, as the length of the pattern is extended, the resistance value of the etched area is increased up to a maximum of 5.9 kΩ, and a deviation of a maximum of 13.75 mA occurs in the drive current. That is, in the second comparative example, the quantity of light output from the light-emitting elements 20, 20', and 20" differs depending on whether the pattern is long or short, so that the optical output of the entire transparent electronic display board is not uniform, thus leading to the conclusion that it is difficult to implement a precise video.

To be compared with the experimental results of the second comparative example, experiments on the second experimental example of the present invention shown in FIG. 8 were conducted under the same experimental conditions, and the drive currents such as those in the following Table 4 were measured.

Here, the second experimental example of the present invention was configured such that the lengths of anode connectivity patterns and the rated voltage of the second comparative example, and the light-emitting elements and transparent electrodes having the same specification as those of the second comparative example were used, except that the widths of the anode connectivity patterns of the first to third groups 210 to 230 were sequentially increased.

The respective widths of the first to third anode connectivity patterns 211 to 213 of the first group 210 were set to 0.5 mm, the respective widths of the anode connectivity patterns 221 to 223 of the second group 220 were set to 2.5 mm, and the respective widths of the anode connectivity patterns 231 to 233 of the third group 230 were set to 4 mm. The lengths L1, L2, and L3 of the connectivity patterns were identical to those of the above-described second comparative example, the sheet resistance of the transparent electrode was set to 14Ω, and the rated voltage was 12 V.

TABLE 4

| Pattern No. | First etched area resistance (theoretical value, kΩ) | First drive current (mA) | Second etched area resistance (measured value, kΩ) | Second drive current (mA) |
|---|---|---|---|---|
| 1 | 1.39 | 8.63 | 1.22 | 6.92 |
| 2 | 1.44 | 8.33 | 1.31 | 5.86 |
| 3 | 1.52 | 7.89 | 1.37 | 5.52 |
| 4 | 1.56 | 7.70 | 1.36 | 6.41 |
| 5 | 1.55 | 7.74 | 1.37 | 5.76 |
| 6 | 1.61 | 7.45 | 1.42 | 5.49 |
| 7 | 1.87 | 6.42 | 1.76 | 5.16 |
| 8 | 1.90 | 6.31 | 1.69 | 4.56 |
| 9 | 1.98 | 6.06 | 1.58 | 4.49 |

In Table 4, the first drive current, which is a theoretical current value checked via the specification of products, was calculated using the above-described Equations 1 and 2, and the second drive current is actually measured data. Further, the widths of the anode connectivity patterns 211 to 233 of the first to third groups 210 to 230 were calculated by utilizing Equations 1 and 2.

The first drive current value and the second drive current value have a maximum deviation of 2.53 mA, which is measured as a value much smaller than a deviation of 13.76 mA of the second comparative example. Therefore, in the present invention, the deviation between the optical outputs of all light-emitting elements 20, 20', and 20" is small regardless of the lengths of the anode connectivity patterns 211 to 233, and thus the entire transparent electronic display board may output uniform light.

In this way, multiple light-emitting elements installed on the transparent electronic display board emit light at uniform optical output, thus enabling an image and a video to be implemented with more precise and clearer image quality.

Although detailed embodiments of the present invention have been disclosed, those skilled in the art will appreciate that various modifications and changes are possible without departing from the technical spirit of the invention, and those modifications and changes belong to the scope of the accompanying claims.

The present invention may correct optical outputs of multiple light-emitting elements installed on a transparent electronic display board to be uniform, so that videos having clearer image quality may be provided using the transparent electronic display board, thus enabling the transparent electronic display board to be potentially utilized for any number of applications including, without limitation, an information provision terminal for advertising, indoor/outdoor interior designs, and wired/wireless communication devices.

What is claimed is:

1. A transparent electronic display board capable of producing a uniform optical output, comprising:

one or more light-emitting elements fixed on at least one surface of a pair of transparent plates bonded to each other so that the transparent plates are spaced apart from each other by a transparent resin;

transparent electrodes formed by applying a conductive material to a corresponding transparent plate and configured to apply power of the one or more light-emitting elements; and connectivity patterns etched from each transparent electrode and connected to respective electrodes of the light-emitting elements at different lengths so that electrical signals are transferred to the light-emitting elements, wherein widths of the connectivity patterns are increased as the lengths of the connectivity patterns connected to the light-emitting elements are increased;

each light-emitting element comprises one or more anode electrodes to which the connectivity patterns are connected, and one cathode electrode;

the connectivity patterns comprise:

one or more anode connectivity patterns etched from the transparent electrode and connected to the anode electrodes; and a single cathode connectivity pattern connected in common to cathode electrodes respectively formed in the multiple light-emitting elements;

connection terminals at which the cathode connectivity pattern and the anode connectivity patterns are sequentially extended from at least one of upper/lower and left/right ends of the transparent plate and are connected to transparent conductive tape are aligned, a connection terminal of the cathode connectivity pattern is formed in an uppermost portion of the connection terminals, and connection terminals of the one or more anode connectivity patterns are sequentially extended below the connection terminal of the cathode connectivity pattern.

2. The transparent electronic display board of claim 1, wherein the widths of the connectivity patterns are calculated by the following Equations 1 and 2:

$$L\ (\text{mm})/W\ (\text{mm}) \times \text{sheet resistance of transparent electrode}\ (\Omega) = \text{resistance of etched area}\ (\Omega) \quad \text{Equation 1}$$

$$\text{rated voltage}\ (V)/\text{resistance of etched area}\ (\text{k}\Omega) = I\ (\text{mA}) \quad \text{Equation 2}$$

where L denotes a length of a connectivity pattern; W denotes a width of the connectivity pattern; 'sheet resistance of transparent electrode' denotes self-sheet resistance of the transparent electrode; 'rated voltage' denotes a voltage applied to the transparent electronic display board; I denotes a current value applied from the connectivity pattern to the corresponding light-emitting element (hereinafter referred to as a 'drive current for the light-emitting element'); and 'resistance of etched area' denotes a resistance value per unit area of the connectivity pattern formed by etching the transparent electrode.

3. The transparent electronic display board of claim 1, wherein:

one or more light-emitting elements are aligned in a horizontal or vertical direction, and a number of anode connectivity patterns identical to a number of anode electrodes of each light-emitting element are extended for each light-emitting element.

4. A transparent electronic display board capable of producing a uniform optical output, comprising:

one or more light-emitting elements fixed on at least one surface of a pair of transparent plates bonded to each other so that the transparent plates are spaced apart from each other by a transparent resin;

transparent electrodes formed by applying a conductive material to a corresponding transparent plate and configured to apply power of the one or more light-emitting elements; and connectivity patterns etched from each transparent electrode and connected to respective electrodes of the light-emitting elements at different lengths so that electrical signals are transferred to the light-emitting elements, wherein widths of the connectivity patterns are increased as the lengths of the connectivity patterns connected to the light-emitting elements are increased;

each light-emitting element comprises one or more anode electrodes to which the connectivity patterns are connected, and one cathode electrode; and the connectivity patterns comprise:

one or more anode connectivity patterns etched from the transparent electrode and connected to the anode electrodes; and a single cathode connectivity pattern connected in common to cathode electrodes respectively formed in the multiple light-emitting elements;

wherein the anode connectivity patterns are respectively connected to two or more anode electrodes of the light-emitting element, and one or more of the anode connectivity patterns are spaced apart from each other with the cathode connectivity pattern interposed therebetween and are connected to the anode electrodes.

5. The transparent electronic display board of claim 4, wherein the widths of the connectivity patterns are calculated by the following Equations 1 and 2:

$$L\ (\text{mm})/W\ (\text{mm}) \times \text{sheet resistance of transparent electrode}\ (\Omega) = \text{resistance of etched area}\ (\Omega) \quad \text{Equation 1}$$

$$\text{rated voltage}\ (V)/\text{resistance of etched area}\ (\text{k}\Omega) = I\ (\text{mA}) \quad \text{Equation 2}$$

where L denotes a length of a connectivity pattern; W denotes a width of the connectivity pattern; 'sheet resistance of transparent electrode' denotes self-sheet resistance of the transparent electrode; 'rated voltage' denotes a voltage applied to the transparent electronic display board; I denotes a current value applied from the connectivity pattern to the corresponding light-emitting element (hereinafter referred to as a 'drive current for the light-emitting element'); and 'resistance of etched area' denotes a resistance value per unit area of the connectivity pattern formed by etching the transparent electrode.

6. The transparent electronic display board of claim 4, wherein one or more light-emitting elements are aligned in a horizontal or vertical direction; and a number of anode connectivity patterns identical to a number of anode electrodes of each light-emitting element are extended for each light-emitting element.

* * * * *